US008424616B2

(12) United States Patent
Marica et al.

(10) Patent No.: US 8,424,616 B2
(45) Date of Patent: Apr. 23, 2013

(54) TRACK GUIDING SYSTEM

(75) Inventors: Adrian Marica, Cypress, TX (US); Ionescu Mihai, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 377 days.

(21) Appl. No.: 12/710,634

(22) Filed: Feb. 23, 2010

(65) Prior Publication Data

US 2011/0203820 A1 Aug. 25, 2011

(51) Int. Cl.
*E21B 19/20* (2006.01)

(52) U.S. Cl.
USPC ..... 173/184; 173/28; 173/29; 173/147; 173/152; 175/57; 175/87

(58) Field of Classification Search ..... 173/147, 173/152, 213, 42, 190, 164, 185, 39, 28, 173/184, 29, 53; 175/57, 87, 113, 162, 220, 175/52

See application file for complete search history.

(56) References Cited

U.S. PATENT DOCUMENTS

| | | | | | |
|---|---|---|---|---|---|
| 3,693,542 | A * | 9/1972 | Moehlenpah | 100/231 |
| 3,867,989 | A * | 2/1975 | Hisey et al. | 173/147 |
| 3,915,244 | A | 10/1975 | Brown | 175/85 |
| 3,994,350 | A | 11/1976 | Smith et al. | 175/85 |
| 4,212,372 | A * | 7/1980 | Murphy et al. | 184/15.3 |
| 4,314,611 | A * | 2/1982 | Willis | 173/197 |
| 4,437,524 | A * | 3/1984 | Boyadjieff et al. | 173/190 |
| 4,489,794 | A | 12/1984 | Boyadjieff | 175/85 |
| 4,589,503 | A | 5/1986 | Johnson et al. | 175/113 |
| 4,625,796 | A * | 12/1986 | Boyadjieff | 166/77.52 |
| 4,629,014 | A | 12/1986 | Swisher et al. | 175/220 |
| 4,813,493 | A * | 3/1989 | Shaw et al. | 173/164 |
| 4,858,700 | A * | 8/1989 | Shafer | 173/185 |
| 5,038,871 | A * | 8/1991 | Dinsdale | 175/52 |
| 5,251,709 | A * | 10/1993 | Richardson | 175/220 |
| 5,381,867 | A * | 1/1995 | Berry | 175/85 |
| 5,433,279 | A * | 7/1995 | Tessari et al. | 173/213 |
| 5,794,721 | A * | 8/1998 | Clonch et al. | 175/45 |
| 5,904,789 | A * | 5/1999 | Durkos | 156/64 |
| 5,921,329 | A * | 7/1999 | Armstrong | 175/57 |
| 6,814,164 | B2 * | 11/2004 | Mills et al. | 175/52 |
| 7,320,374 | B2 * | 1/2008 | Folk et al. | 175/220 |
| 2003/0006043 | A1 | 1/2003 | Luca et al. | 166/379 |
| 2004/0136813 | A1 | 7/2004 | Pietras | 414/22.51 |
| 2005/0269072 | A1 | 12/2005 | Folk et al. | 166/90.1 |
| 2006/0118294 | A1 | 6/2006 | Haakenson | 166/77.52 |

* cited by examiner

*Primary Examiner* — Scott A. Smith
(74) *Attorney, Agent, or Firm* — Williams, Morgan & Amerson, P.C.

(57) ABSTRACT

A track guiding system includes a track comprising a linear beam and a linear plate operatively coupled to the linear beam. The linear plate has opposing first and second surfaces separated by a first distance and opposing first and second edges separated by a second distance. A first compound edge roller and a second compound edge roller are disposed adjacent to the first and second edges of the linear plate, respectively, for travel along the first and second edges of the linear plate. Each of the first and second compound edge rollers include a first roller element adjacent to the first surface of the linear plate and a second roller element adjacent to the second surface of the linear plate. A carriage is coupled to the first and second compound edge rollers.

23 Claims, 6 Drawing Sheets

TRACK GUIDING SYSTEM

BACKGROUND OF THE INVENTION

1. Field of the Invention

The present disclosure relates generally to track guiding systems for guiding travel of an object along a defined path, and more particularly to a track guiding system for guiding travel of an object along a vertical path.

2. Description of the Related Art

A top drive is an example of a device requiring guided travel along a defined path. In this case, the defined path is a vertical path. The top drive is used to rotate a drill string from the top of the drill string, typically while the drill string is in a borehole. The top drive includes at least one motor and a gear system. The motor is coupled to the gear system, and the gear system is connected to a short pipe, which is in turn attached to the top of the drill string. The top drive is suspended on a hook at the end of a traveling block. The traveling block itself is suspended by cables from the top of a derrick. The traveling block moves up and down the derrick by means of the cables, and the top drive moves with the traveling block. A track guiding system is used to guide the travel of the top drive in a vertical direction along the derrick. Typically, the track guiding system includes a wheeled carriage adapted to run on a pair of vertical tracks. The vertical tracks are anchored to the rig floor or bottom of the derrick and extend up the derrick. The top drive is coupled to the wheeled carriage for guided travel up and down the vertical tracks.

FIG. 1 is a perspective view of a prior-art track guiding system for guiding travel of a top drive along a vertical path. The vertical track guiding system includes a beam 1 having parallel sides 3, 5. Tracks 4, 6 are formed at the parallel sides 3, 5, respectively. The following discussion applies to both tracks 4, 6, but only track 4 will be specifically mentioned. Track 4 consists of plates 7, 9, which are welded to the side 3 of the beam 1. The plates 7, 9 are spaced apart to define a channel 15. Rollers 17, which are coupled to a carriage 21, travel in and along the channel 15. The rollers 17 and carriage 21 constitute a wheeled carriage. In use, the top drive (not shown) would be mounted on the carriage 21 for guided travel along the tracks 4, 6.

For the vertical track guiding system of FIG. 1, ideally, the plates 7, 9 should be parallel so that the channel 15 has a constant width along the length of the beam 1, the width being the gap between the plates 7, 9. However, because of distortion of the plates 7, 9, either during manufacturing of the plates or attachment of the plates to the beam 1, the plates 7, 9 will not be truly parallel. Non-parallelism would occur even if the plates 7, 9 were initially precisely positioned on the beam 1. Very often, the width at one or more points in the channel 15 will be smaller than the width of the rollers 17 so that the rollers 17 become periodically jammed in the channel 15. A pulling force applied to the top drive (not shown) coupled to the carriage 21 will dislodge the rollers 17 from the jammed position, but at a cost, i.e., the rollers 17 will deform the plates 7, 9. At these deformed locations in the channel 15, the rollers 17 will either wobble or slide (as opposed to roll) along the plates 7,9.

Typically, several lengths of beams are stringed together to form a sufficient length of track to guide the travel of the top drive up and down the derrick. Connections between the plates on adjacent beams are typically not smooth, particularly because it is difficult to make two beams and plate attachments that have the same dimensions and tolerances. Rollers tend to jump when they encounter these non-smooth connections.

Wobbling, sliding or jumping of the rollers will adversely affect the stability of the top drive as the top drive travels up and down the guiding system. Instability of the top drive may, in turn, affect the quality of the borehole being drilled by the drill string. Deformation of the track plates may also reduce longevity of the track guiding system.

While the top drive is coupled to a guided wheeled carriage and used to rotate a drill string, the axial axis of the top drive needs to be aligned with the vertical. In the current art, a screw-type fixed-adjustment mechanism is used initially to adjust the verticality of the top drive. Subsequent adjustments may take place at regular operating time intervals or when required. In the current art, operators have to periodically, or as required, physically measure the verticality of tracks at a given position along the tracks where the top drive is located and then adjust the verticality of the top drive based on this measurement. With this approach, verticality is adjusted for a given position of the top drive along the tracks. Since it is unknown how the tracks will deform while in operation or after a certain period, the verticality adjustment of the top drive is valid only for the given position of the top drive along the tracks. During drilling, the position of the top drive along the tracks will vary, and the top drive may not be truly vertical for a portion of its travel along the tracks. This can result in drilling of a poor-quality borehole, e.g., one having a non-uniform cross-section where a uniform cross-section is desired.

The present disclosure is directed to various methods and devices that may avoid, or at least reduce, the effects of one or more of the problems identified above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the subject matter disclosed herein relates to a top drive track guiding system used for drilling boreholes. The track guiding system may also be adjusted during operation so as to maintain alignment of the top drive in a substantially vertical direction.

According to one illustrative embodiment of the present subject matter, a track guiding system comprising a track is disclosed, the track comprising a linear plate operatively coupled to a linear beam, the linear plate having first and second surfaces separated by a plate thickness and first and second edges separated by a plate width. The track guiding system further comprises first and second compound edge rollers, each disposed adjacent to and adapted to travel along the first and second edges of the linear plate, respectively. Furthermore, the first compound edge roller comprises a first roller element adjacent the first surface of the linear plate, and the second compound edge roller comprises a second roller element adjacent the second surface of the linear plate. The guide tracking system also comprises a carriage coupled to the first and second compound edge rollers.

According to another illustrative embodiment of the present subject matter, a track guiding system comprising a linear beam and a linear plate is disclosed, the linear beam comprising a plurality of linear beam segments, and the linear plate comprising a plurality of linear plate segments, wherein each of the linear plate segments is operatively coupled to one of the linear beam segments. Furthermore, each of the linear plate segments has opposing front and back surfaces separated by a plate thickness, opposing side edges separated by a plate width, and opposing prong and receptor ends separated by a plate length. Moreover, each of the prong ends has an outer edge that is tapered along the plate thickness and plate length, and each of the receptor ends has an inner edge that is tapered along the plate thickness and plate length.

According to yet another illustrative embodiment of the present subject matter, a method of guiding a top drive is disclosed, the method comprising mounting a top drive on a carriage coupled to compound edge rollers that are disposed adjacent to opposite edges of a track, the track comprising a linear plate operatively coupled to a linear beam. The method further comprises moving the top drive relative to the track, wherein during the movement of the top drive, roller elements of each of the compound edge rollers roll on opposing surfaces of the linear plate, and the opposing surfaces of the linear plate are separated by a plate thickness.

BRIEF DESCRIPTION OF THE DRAWINGS

The disclosure may be understood by reference to the following description taken in conjunction with the accompanying drawings, in which like reference numerals identify like elements, and in which.

Figure 1:
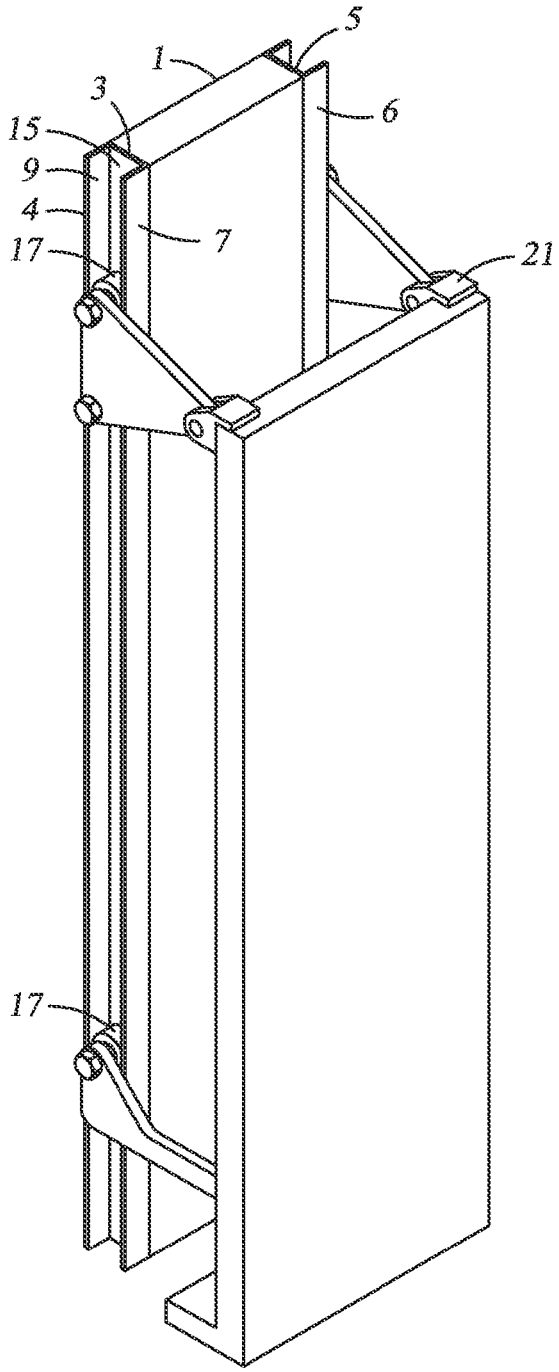
FIG. 1 (PRIOR ART)
FIG. 1 is a perspective view of a prior-art vertical track guiding system for a top drive.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
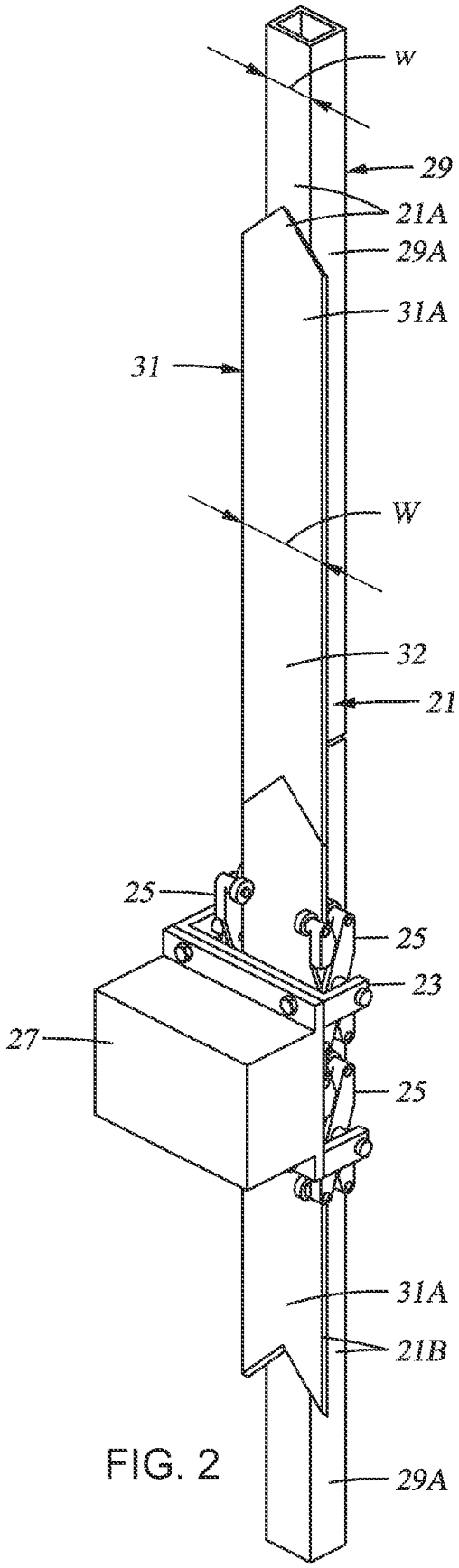
FIG. 2 is a perspective view of a top drive coupled to an illustrative track guiding system as disclosed herein.

FIG. 2 shows one illustrative embodiment of a track guiding system disclosed herein, including a track 21 and a carriage 23. The carriage 23 may be, for example, any structure or platform or frame to which an object needing travel along a specified path may be coupled. The carriage 23 and any object coupled to it may travel along the track 21 by means of compound edge rollers 25 operatively coupled to the carriage 23 and mounted on the track 21. In the embodiment shown in FIG. 2, the carriage 23 and compound edge rollers 25 constitute a wheeled carriage. In some embodiments, there can be at least a pair of compound edge rollers 25 at the opposite edges of the track 21. In the illustrative embodiment shown in FIG. 2, for example, there are two pairs of compound edge rollers 25, with a pair each at the opposite edges of the track 21. As shown in FIG. 2, one example of an object that may be coupled to the carriage is a top drive 27. In alternative uses of the track guiding system, other types of objects, e.g., robot or camera, may be coupled to the carriage 23. In FIG. 2, the various attachments to the top drive 27 are not shown, but these attachments are well known in the art.

As illustrated in FIG. 2, the track 21 is typically oriented in a vertical direction to guide travel of the carriage 23 and any object coupled to it along a substantially vertical path. In alternative uses of the track guiding system, the track 21 may be oriented in other directions, e.g., horizontal or inclined, for guided travel of the carriage 23 and any object coupled to it along a corresponding non-vertical path. In some embodiments, the track 21 may be made of, for example, a linear beam 29 and a linear plate 31. In yet other embodiments, the linear beam 29 may be made of one or more separate linear beam segments 29A. Similarly, the linear plate 31 may, in some embodiments, be made of one or more separate linear plate segments 31A. Typically, there are equal numbers of linear beam segments 29A and linear plate segments 31A, with one linear beam segment 29A for each linear plate segment 31A. In such embodiments, each linear plate segment 31A is operatively coupled to one of the linear beam segments 29A. A linear beam segment 29A operatively coupled to a linear plate segment 31A may be regarded as a track segment. Thus, the track 21 may also be considered as being made up of one or more track segments. In the embodiment illustrated in FIG. 2, there are two types of track segments, designated as 21A and 21B. The differences between track segment type 21A and track segment type 21B are in the positioning and length of the linear plate segment 31A relative to the attached linear beam segment 29A. In track segment type 21A, the lengths of the linear plate segment 31A and the attached linear beam segment 29A are approximately the same, the linear plate segment 31A overlaps the attached linear beam segment 29A, and an end portion 32 of the linear plate segment 31A overhangs the attached linear beam segment 29A. In track segment type 21B, the linear plate segment 31A is shorter than the attached linear beam segment 29A, the linear plate segment 31A overlaps the attached linear beam segment 29A, and there is no end portion of the linear plate segment 31A that overhangs the attached linear beam segment 29A. In some embodiments, the track segment type 21B is used at the bottom of the track 21, while the subsequent track segments in the track 21 are of type 21A. The linear beam segments 29A and the linear plate segments 31A could, in some illustrative embodiments, be made of metal material, alloy material, composite material, or a combination of metallic and composite materials. The linear plate segments 31A could be operatively coupled to the linear beam segments 29A by any number of methods well known those skilled in the art, such as, for example, by welding and the like.

Figure 3:
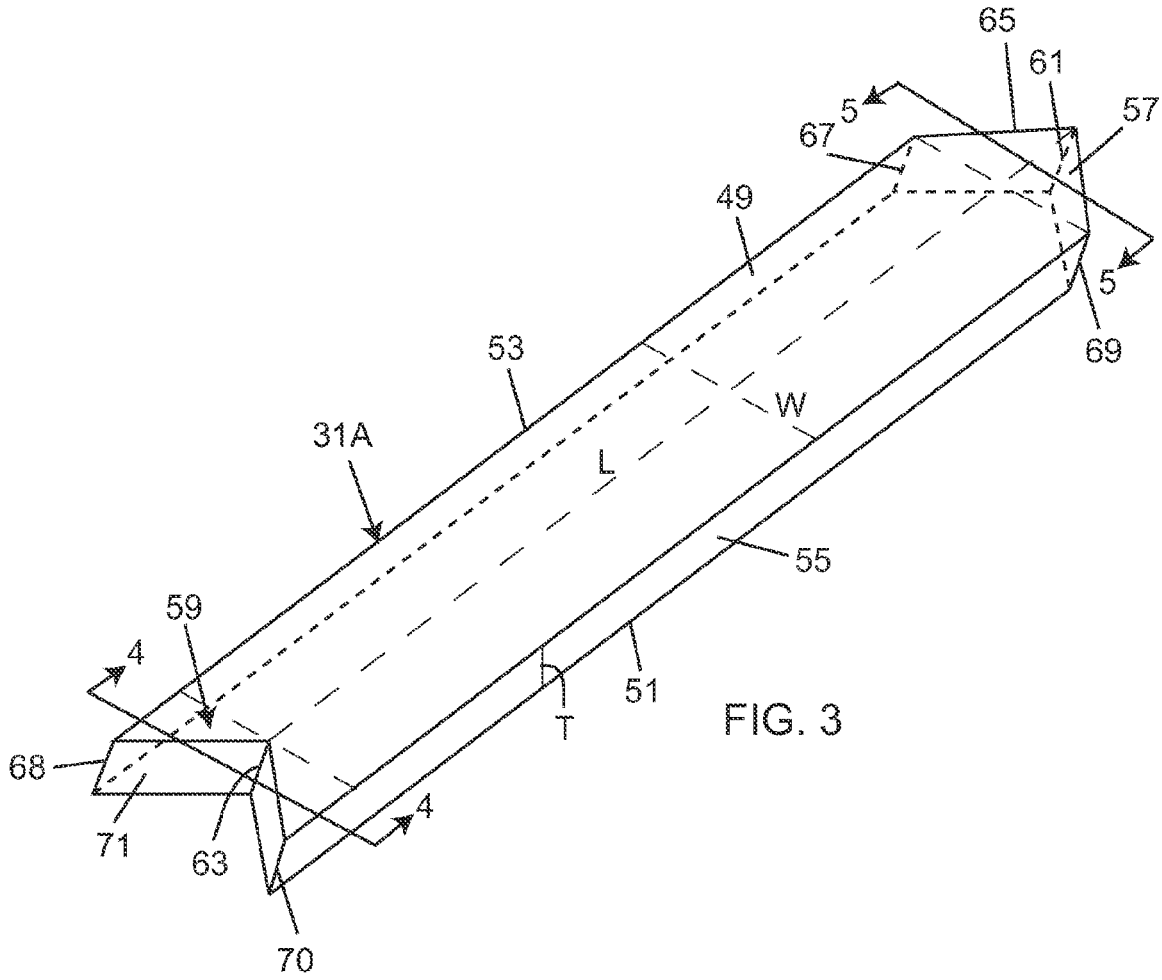
FIG. 3 is a perspective view of a linear plate segment of one illustrative embodiment of the track guiding system disclosed herein.

FIG. 3 is a perspective view of one illustrative embodiment of the linear plate segment 31A. As shown in FIG. 3, the linear plate segment 31A may have opposing front and back surfaces 49, 51, separated by a distance, such as for example a plate thickness T. The back surface 51 of linear plate segment 31A is operatively coupled to a corresponding linear beam segment (see 29A, 31A in FIG. 2). In FIG. 3, the linear plate segment 31A has opposing side edges 53, 55, separated by a distance, such as for example a plate width W. The linear plate segment 31A also has opposing ends 57, 59, separated by a distance, such as for example a plate length L. Depending on the specific application, the plate length L may be of any appropriate length, but in some embodiments is at least several feet long. The plate width W may be small compared to the plate length L, the plate thickness T may be small compared to the plate width W, and furthermore the plate thickness T may be very small compared to the plate length L. In some embodiments, the plate length L may be on the order of 30 feet and the plate thickness T may be on the order of 1 inch, but it should be appreciated by those skilled in the art that other dimensions may be used, and that these values are not intended to impose any limitations on the plate length and plate thickness. In subsequent discussion, the plate end 57 will be referred to as the prong end, while the plate end 59 will be referred to as the receptor end, and the reason for this naming convention will be apparent shortly. In certain embodiments, the prong end 57 may be outwardly tapered along the plate length L and the receptor end 59 may be inwardly tapered along the plate length L. Thus, the prong end 57 may be designed to plug into something, e.g., a receptor, while the receptor end 59 may be designed to receive something, e.g., a prong. For purposes of discussions related to the prong end 57, "outwardly-tapered" means that the apex 61 of the prong end is outboard of the linear plate segment 31A. Likewise, for purposes of discussions related to the receptor end 59, "inwardly-tapered" means that the apex 63 of the receptor end 59 is inboard of the linear plate segment 31A.

In certain illustrative embodiments, the prong end 57 may be externally V-shaped, whereas the receptor end 59 may be internally V-shaped. The apices 61, 63 of the prong end 57 and receptor end 59, respectively, could in some embodiments be sharp, or in other embodiments be rounded. In the illustrative embodiment shown in FIG. 3, the prong end 57 has an outer edge 65 that is contiguous with the opposing side edges 53, 55 of the linear plate segment 31A. The corners 67, 69 between the outer edge 65 and the opposing edges 53, 55 may in some cases be rounded to avoid stress concentration at those corners. Similarly, the receptor end 59 has an inner edge 71 that is contiguous with the opposing side edges 53, 55 of the linear plate segment 31A. The corners 68, 70 between the inner edge 71 and the opposing side edges 53, 55 may also be rounded to avoid stress concentration at those corners. In some embodiments, the outer edge 65 of the prong end 57 may be tapered along the plate thickness T. In certain other embodiments, the inner edge 71 of the receptor end 59 may be tapered along the plate thickness T.

Figure 4:
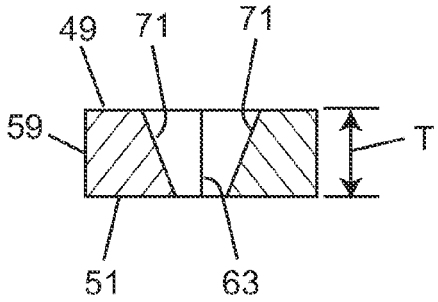
FIG. 4 is a cross-section of the linear plate segment of FIG. 3 along line 4-4.
Figure 5:
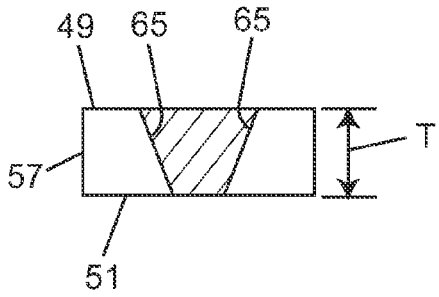
FIG. 5 is a cross-section of the linear plate segment of FIG. 3 along line 5-5.

FIG. 4 shows a cross-section of one illustrative embodiment of the linear plate segment 31A, where the section line is cut through the receptor end 59, along line 4-4. In embodiment shown in FIG. 4, the taper of the inner edge 71 of the receptor end 59 slopes inwardly from the front surface 49 to the back surface 51. FIG. 5 shows a similar cross-section at the opposite end of the linear plate segment 31A, where the section line is cut through the prong end 57, along line 5-5. In FIG. 5, the taper of the outer edge 65 of the prong end 57 slopes outwardly from the front surface 49 to the back surface 51. In some illustrative embodiments, it is also possible to make the taper of the outer edge 65 of the prong end 57 to slope inwardly from the front surface 49 to the back surface 51 and the taper of the inner edge 71 of the receptor end 59 to slope outwardly from the front surface 49 to the back surface 51. In general, the slope direction of the taper of the outer edge 65 should be opposite to the slope direction of the taper of the inner edge 71. The corners 67, 69, 68, 70 (see FIG. 3) may also be tapered along the plate thickness T. In this case, the slope direction of the taper of the corners 67, 69 would be opposite to the slope direction of the taper of the corners 68, 70.

Figure 6:
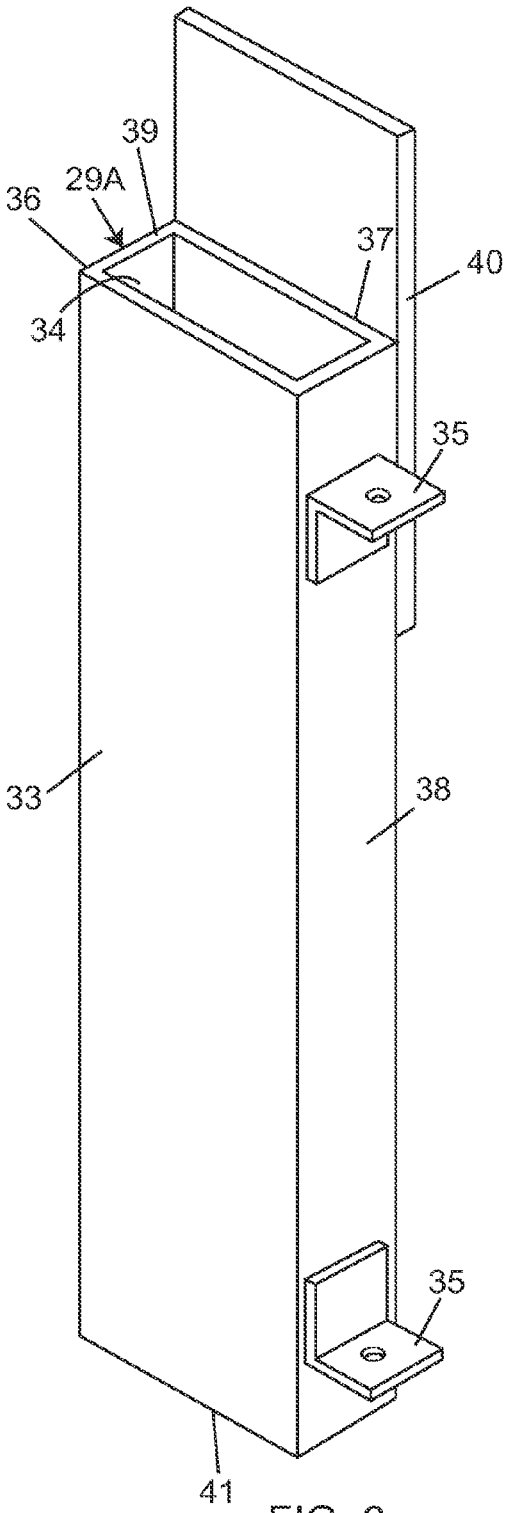
FIG. 6 is a perspective view of a linear beam segment of one illustrative embodiment of the track guiding system disclosed herein.

FIG. 6 shows a perspective view of certain embodiments of the linear beam segment 29A. Depending on the specific application, the linear beam segment 29A may be of any appropriate length, but in some embodiments is at least several feet long. In some embodiments, the linear beam segment 29A may have a tubular or open profile, and in other embodiments may be solid or hollow. The cross-section of the linear beam segment 29A may have any desired shape, e.g., rectangular, square, triangular, U, and W. For example, in the embodiment illustrated in FIG. 6, the linear beam segment 29A has a tubular profile, a rectangular cross-section, and is hollow with an internal cavity 34. Each linear beam segment 29A has a front surface 33 to which a linear plate segment (31A in FIG. 2) may be operatively coupled. In some embodiments, the front surface 33 is planar. Referring to the illustrative embodiment shown in FIG. 2, the width w of the linear beam segment 29A is smaller than the width W of the corresponding linear plate segment 31A, so that the opposite side edges of the linear plate segment 31A overhang the side edges of linear beam segment 29A. This configuration allows the compound edge rollers 25 to roll along the side edges of the linear plate segment 31A without interference from the linear beam segment 29A.

Returning to FIG. 6, the linear beam segment 29A has a back surface 37 in opposing relation to the front surface 33. In certain illustrative embodiments, the back surface 37 is also planar. In the embodiment illustrated in FIG. 6, an alignment plate 40 is operatively coupled to the back surface 37 such that it overhangs the end 39 of linear beam segment 29A. The relevance of the alignment plate 40 will be explained below. The linear beam segment 29A also has opposing side surfaces 36, 38, to at least one of which connection or end tabs 35 may be attached. As shown in FIG. 6, connection tabs 35 may be attached near the opposite ends 39, 41 of the linear beam segment 29A. The relevance of the connection tabs 35 will also be explained below.

Figure 7:
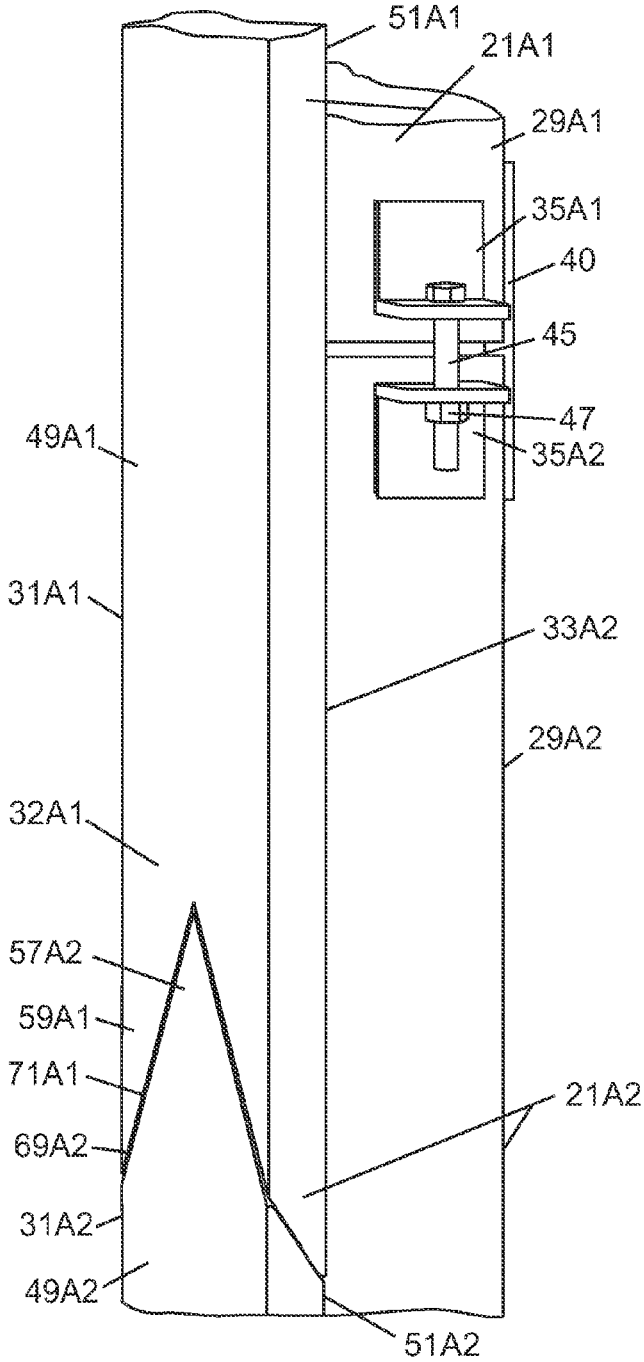
FIG. 7 shows an illustrative connection between two track segments of the track guiding system disclosed herein.

FIG. 7 shows an illustrative connection between two track segments 21A1 and 21A2. The "1" and "2" identifiers appended to 21A are used to identify two of the same track segment. This convention will be adhered to when referring to two objects of the same type, where the details of the objects have already been described above. In the embodiment illustrated in FIG. 7, the track segment 21A1 has a linear plate segment 31A1 operatively coupled to a linear beam segment 29A1, and the track segment 21A2 has a linear plate segment 31A2 operatively coupled to a linear beam segment 29A2. In this mode, the prong end 57A2 of the linear plate segment 31A2 is received in and engaged with the receptor end 59A1 of the linear plate segment 31A1. The inner edge 71A1 of the receptor end 59A1 pushes the outer edge 69A2 of the prong end 57A2 in between the inner edge 71A1 of the receptor end 59A1 and the linear beam segment 29A2 operatively coupled to the linear plate segment 31A2. In general, when a first linear plate segment operatively coupled to a first linear beam segment is connected to a second linear plate segment operatively coupled to a second linear beam segment, the receptor end of the first linear plate segment will push the prong end of the second linear plate segment against the first linear beam segment.

At the joint between the track segments 21A1, 21A2, a portion 32A1 of the linear plate segment 31A1 including the receptor end 59A1 overhangs the linear beam segment 29A1 to which the linear plate segment 31A1 is operatively coupled. This linear plate segment portion 32A1 overlaps and rests on the linear beam segment 29A2 operatively coupled to the linear plate segment 31A2. In addition, in some embodiments the alignment plate 40 operatively coupled to the linear beam segment 29A2 may abut the back surface of the linear beam segment 29A1 so that a socket is formed where the two beams segments 31A1 and 31A2 are coupled together. In certain other illustrative embodiments, after the prong end 57A2 and the receptor end 59A1 are pulled together, the tabs 35A1, 35A2 on the linear beam segments 29A1, 29A2 may be fastened together so as to maintain the connection between the prong end 57A2 and receptor end 59A1 in a firm and stable position. The tabs 35A1, 35A2 may be fastened together using any suitable fastening mechanism known in the art, such as bolts, screws, clamps, couplers and the like. The embodiment illustrated in FIG. 7 shows a bolt 45 inserted into the tabs 35A1, 35A2 and held in place by a nut 47. Other types of fasteners may alternatively be used. In this manner, two or more track segments may be connected as shown in FIG. 7 and described above.

With the arrangement illustrated by the embodiment shown in FIG. 7 and described above, the back surfaces 51A1 and 51A2 of the two linear plate segments 31A1 and 31A2, respectively, are aligned (or flush) due to the back surfaces 51A1, 51A2 of the linear plate segments 31A1, 31A2 overlapping and resting on the same front surface 33A2 of the linear beam segment 29A2. The opposed tapers on the inner edge 71A1 (of the receptor end 59A1) and outer edge 69A2 (of the prong end 57A2) align and secure the linear plate segments 31A1, 31A2 in a plane that is substantially perpendicular to the surfaces 31A1 and 31A2. If P1 is defined as a plane that is substantially perpendicular to the linear plate segment 31A1 and containing the longitudinal axes of the linear plate segment 31A1 and attached linear beam segment 29A, and P2 is defined as a plane that is substantially perpendicular to the linear plate segment 31A2 and containing the longitudinal axes of the linear plate segment 32A2 and attached linear beam segment 29A, then P1 and P2 are substantially coplanar when the track segments 21A1 and 21A2 are aligned as shown in FIG. 7. The front surfaces 49A1, 49A2 of the two adjacent linear plate segments 31A1, 31A2 may or may not be aligned (or flush). As will be described below, the compound edge rollers (25 in FIG. 2) that will ride on these surfaces may be elastic-supported, which in some embodiments may enable the compound edge rollers 25 to compensate for any discontinuity at the interface between the front surfaces 49A1, 49A2 of the adjacent linear plate segments 31A1, 31A2.

Figure 8:
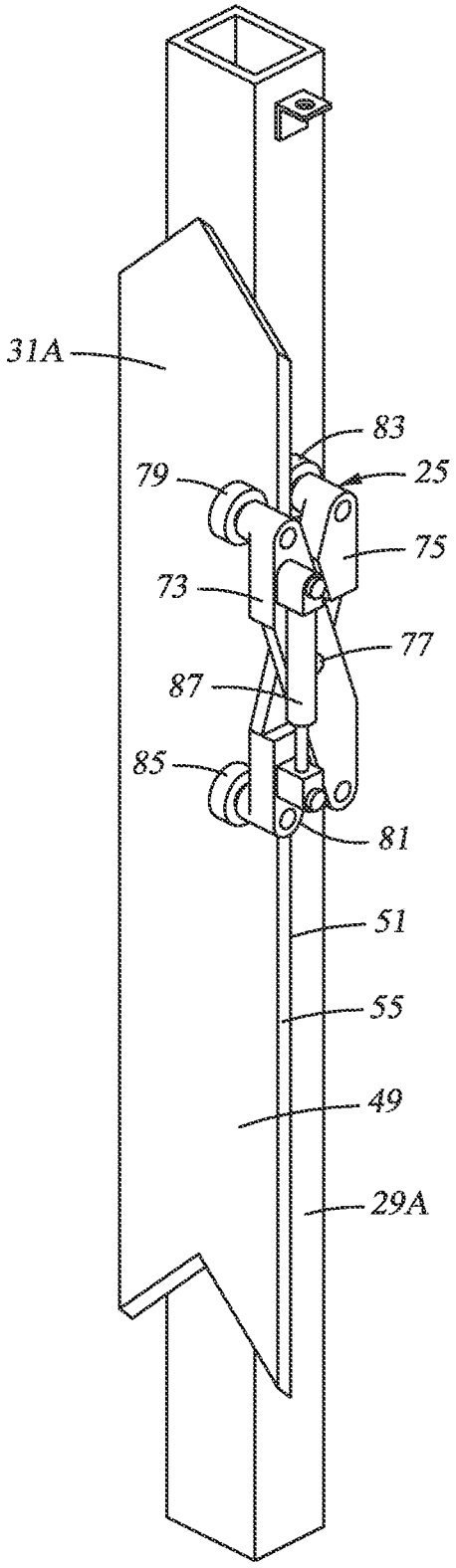
FIG. 8 shows an illustrative embodiment of a first compound edge roller at an edge of a linear plate segment operatively coupled to a linear beam segment of the track guiding system disclosed herein.

FIG. 8 shows certain illustrative embodiments of the present subject matter, including a compound edge roller 25 (one of the two pairs previously shown in FIG. 2) at the edge 55 of a linear plate segment 31A. In the illustrative embodiment shown, the linear plate segment 31A is operatively coupled to a linear beam segment 29A. For clarity, other components of the track guiding system are omitted from FIG. 8 to allow focus on the features of the compound edge roller 25. As shown in FIG. 8, the compound edge roller 25 includes arms 73, 75 coupled together and rotatable about the joint 77. The joint 77 may be any suitable rotatable joint formed in any suitable manner known in the art. For example, in some illustrative embodiments the joint 77 may be formed by providing holes in each of the arms 73, 75 coincident with the location of the joint 77, inserting a bolt through the coincident holes and securing the bolt in place. In other illustrative embodiments, a pin is formed on one of the arms 73, 75 and a hole is formed on the other of the arms 73, 75 coincident with the location of the joint 77. In such embodiments, the pin is inserted in the hole and secured with a lock member, such as a nut, to prevent the pin from being dislodged from the hole. In yet other embodiments, the pin may be self-locking, i.e., it may include a snap feature for securing the other arm in place. As illustrated in FIG. 2, the carriage 23 may also, in some illustrative embodiments, be coupled to the compound edge roller 25 at the rotatable joint 77 of the compound edge roller 25.

Returning to FIG. 8, in some embodiments the arm 73 may carry two roller elements (or rollers) 79, 81 and the arm 75 may also carry two roller elements (or rollers) 83, 85. In certain illustrative embodiments, the roller elements 79, 85 may be adjacent to the front surface 49 of the linear plate segment 31A, and the roller elements 83, 81 may be adjacent to the back surface (51 in FIG. 7) of the linear plate segment 31A. In the illustrative embodiment shown in FIG. 8, roller elements 79, 81 and 83, 85 are supported on the arms 73, 75, respectively, so that they can rotate relative to the arms 73, 75, respectively. For example, spools (or studs) may be formed on the supports arms 73, 75, and the roller elements may be cylindrical rollers having a hole in center thereof for mounting on the spools. The spools may be self-locking, or a lock member, such as a nut, collar, ferrule and the like, may be used to secure the roller elements such that the roller elements do not slip off the arms during use. In one illustrative embodiment, a roller element may be made of a rigid cylindrical element. Alternatively, in certain other illustrative embodiments a roller element may be made of two rigid cylindrical elements with an elastomer sandwiched between the cylindrical elements.

In other illustrative embodiments, the compound edge roller may have only three roller elements in lieu of the four roller elements 79, 81 and 83, 85 as illustrated in FIG. 8. That is, one of the roller elements, e.g., roller 81, may be eliminated, such that the compound edge roller has two arms and carries three roller elements in total on the two arms 73, 75. In some illustrative embodiments, a first of the three roller elements may be adjacent to the front surface of the linear plate segment, a second of the three roller elements may be adjacent to the back surface of the linear plate segment, and a third of the three roller elements may be adjacent to the front surface of the linear plate segment. In yet another illustrative embodiment, the first and second of the three roller may be located adjacent to the front and back surfaces, respectively, of the linear plate segment as noted above, whereas the third of the three rollers may be adjacent to back surface of the linear plate segment.

In certain illustrative embodiments of the present subject matter, a tensioning member 87 may be coupled to the arms 73, 75. (To simplify the drawings, the tensioning member 87 is not visible in FIG. 2.) In general, the rotational axis of each roller element is perpendicular to the longitudinal axis (i.e., the length) of the arm on which it is rotatably supported. As shown in FIG. 8, the tensioning member 87, as-coupled, is between the arms 73, 75 and serves to apply a force that biases the arms 73, 75 away from each other in one direction and towards each other in another direction. That is, the tensioning member 87 may be actuated to move the arms in much the same way that a pair of scissors operates when being opened or closed. The tensioning member 87 thereby applies the force such that contact is maintained between the roller elements 79, 81 and 83, 85 and the front and back surfaces 49, 51 of the linear plate segment 31A, respectively, as the compound edge roller 25 rolls along the edge 55 thereof. The tensioning member 87 may be any mechanism capable of applying force to the arms 73, 75 in the manner described above. For example, in some illustrative embodiments the tensioning member 87 may be a fluid-powered cylinder, e.g., a hydraulic cylinder or a pneumatic cylinder. Alternatively, in certain other embodiments the tensioning member 87 may be a type of spring element, such as a tension spring, compression spring, torsion spring or clip spring. In those embodiments utilizing a fluid-powered cylinder, the cylinder may be coupled to one of the arms 73, 75, and the piston or ram (which is axially movable relative to the cylinder) may be coupled to the other of the arms 73, 75. The tensioning member 87 may in some embodiments be pre-configured to apply a certain amount of force to the arms 73, 75 to maintain contact between the roller elements and the surfaces of the linear plate segment 31A as previously described. The tensioning member 87 thereby allows the compound edge roller 25 to be "elastic," which in the present instance means that the compound edge roller 25 is capable of dynamically adapting to the profile of the surface along which it travels.

Figure 9:
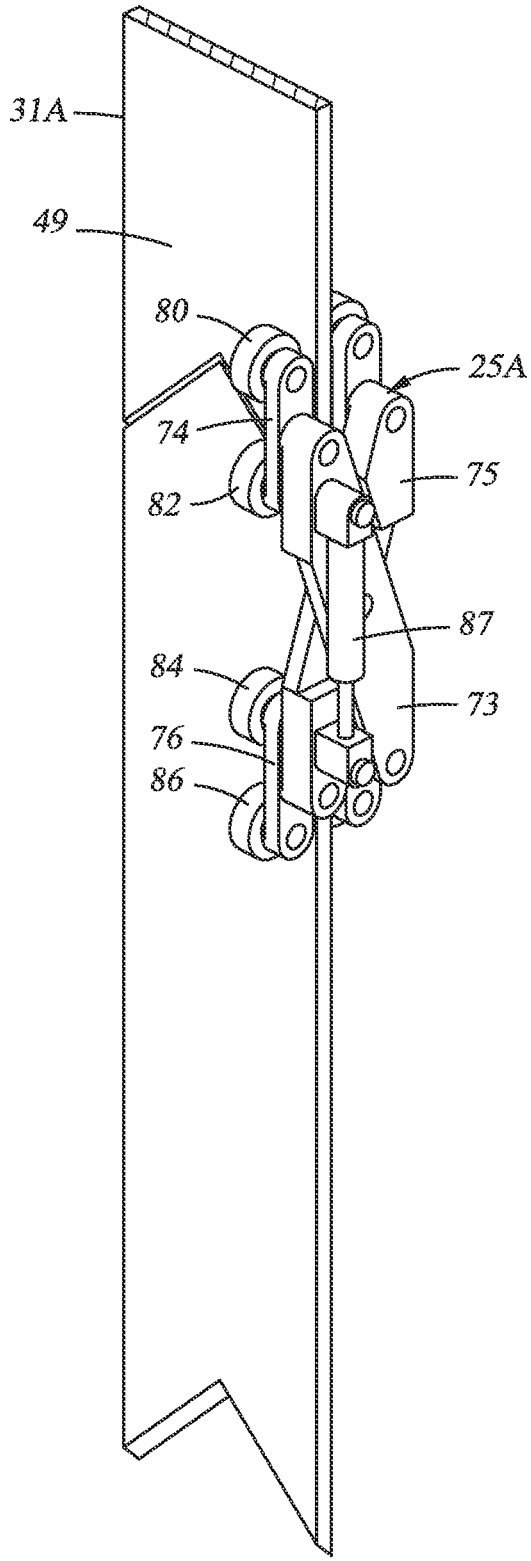
FIG. 9 shows an illustrative embodiment of a second compound edge roller at an edge of a linear plate segment of the track guiding system disclosed herein.

FIG. 9 shows another illustrative embodiment of a compound edge roller. The compound edge roller 25A shown in FIG. 9 may be similar to the compound edge roller 25 of FIG. 8 in many aspects, however compound edge roller 25A additionally comprises plates 74, 76 operatively coupled to one end of each of the arms 73, 75, respectively. In the embodiment illustrated in FIG. 9, plates 74, 76 are operatively coupled to the ends of arms 73, 75 adjacent to the front surface 49 of the linear plate segment 31A. Plate 74 carries two roller elements 80, 82, while plate 76 carries two roller elements 84, 86. In some embodiments, tensioning member 87 may also help maintain contact between the rollers on the arms 73, 75 and plates 74, 76 and the surfaces of the linear plate segment 31A as the compound edge roller 25A travels along the edge of the linear plate segment 31A. As will be appreciated by those skilled in the art and having the benefit of the present disclosure, compound edge roller 25A may be used in place of compound edge roller 25 shown in FIG. 2.

Figure 10:
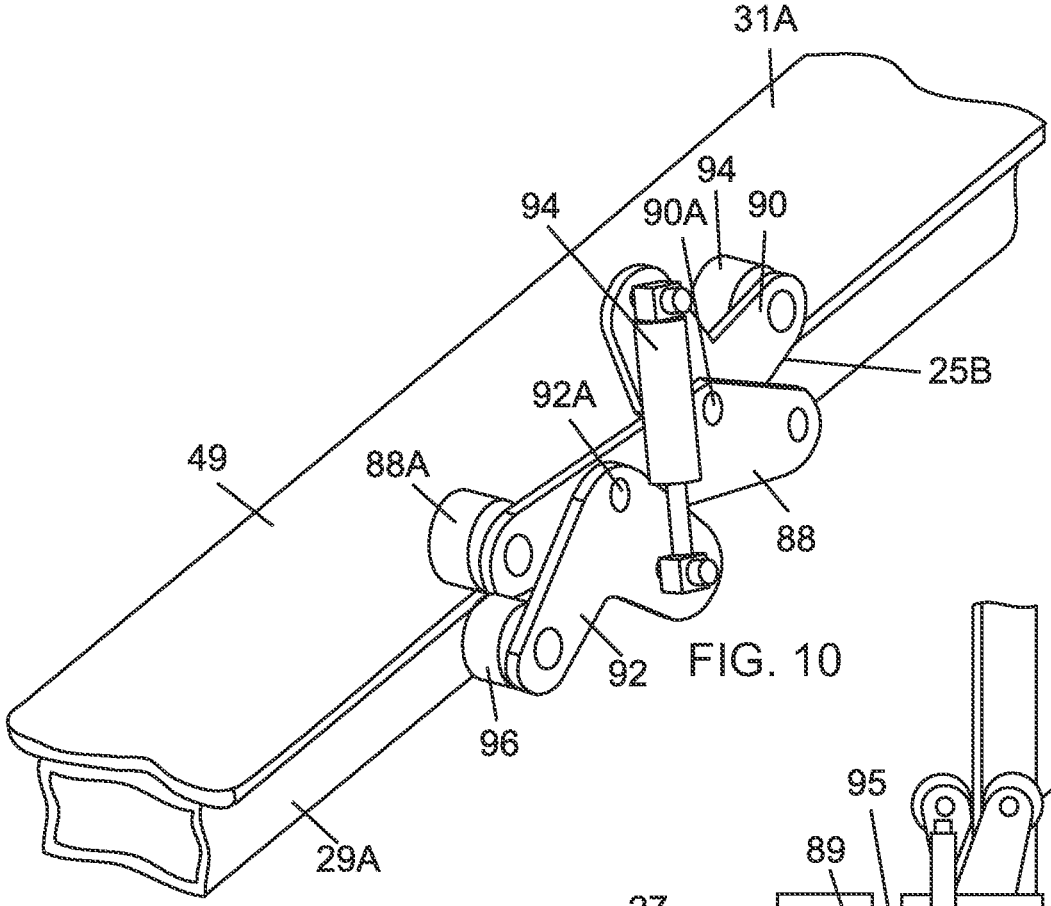
FIG. 10 shows an illustrative embodiment of a third compound edge roller at an edge of a linear plate segment of the track guiding system disclosed herein.

FIG. 10 shows yet another illustrative embodiment of a compound edge roller 25B, comprising a main arm 88 and two auxiliary arms 90, 92. In some embodiments, main arm 88 is generally linear or elongated in shape and carries roller elements 88A on opposing ends (only one roller element 88A is visible in FIG. 10). Auxiliary arm 90 has an angular or triangular shape and comprises a roller element 94 operatively coupled to one end thereof. In certain embodiments, the middle of auxiliary arm 90 is operatively coupled to main arm 88 at joint 90A such that auxiliary arm 90 is independently rotatable relative to main arm 88. Similarly, auxiliary arm 92 has an angular or triangular shape and comprises a roller element 96 operatively coupled to one end thereof. The middle of auxiliary arm 92 is similarly coupled to main arm 88 at joint 92A such that auxiliary arm 92 is also independently rotatable relative to main arm 88. In one illustrative embodiment, a tensioning member 94 is also operatively coupled to diametrically-opposed ends of the auxiliary arms 90, 92 (i.e., the ends of the auxiliary arms not coupled to roller elements 94, 96 or to main arm 88). The tensioning member 94 is as described above for the compound edge roller 25 (87 in FIG. 8) and operates to maintain contact between the roller elements 88A, 94, 96 carried by the main and auxiliary arms 88, 90, 92, respectively and the front and back surfaces of the linear plate segment 31A. As will be appreciated by those skilled in the art and having the benefit of the present disclosure, compound edge roller 25B may also be used in place of the compound edge roller 25 in FIG. 2.

Figure 11:
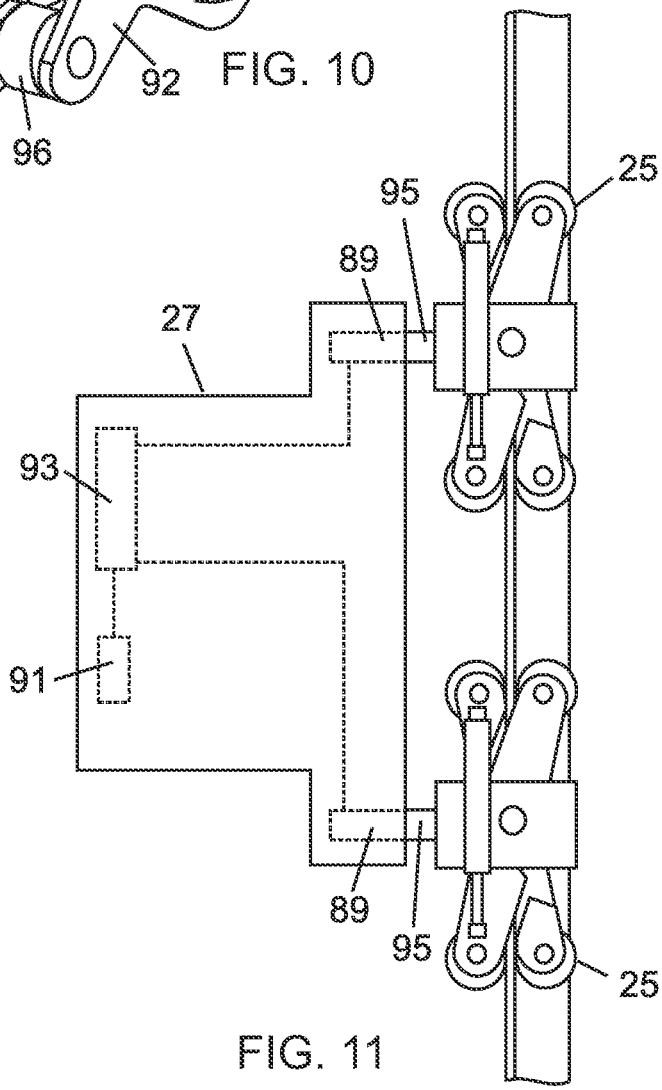
FIG. 11 shows an elevation view of a top drive coupled to one illustrative embodiment of the track guiding system disclosed herein.

FIG. 11 shows one illustrative embodiment of an interface between the top drive 27 and the carriage 23. As shown in FIG. 11, one or more movable joints 95 may be formed between the top drive 27 and the carriage 23. In some embodiments, movable joints 95 may be adjusted to tilt the top drive 27 relative to the vertical, e.g., in order to adjust the verticality of the top drive 27. In certain embodiments, the movable joints 95 are extensible joints that may be extended or shortened to tilt the top drive 27 relative to the vertical. In certain other embodiments, the extensible joints may be provided by actuators 89 operatively coupled to both the top drive 27 and the carriage 23. In one illustrative embodiment, the actuators 89 may be linear actuators, which may in certain specific embodiments be fluid-powered cylinders, e.g., hydraulic or pneumatic cylinders. In further embodiments of the present subject matter, at least three spaced-apart extensible joints 95 may be provided to allow tilting adjustment of the top drive in three-dimensions, each of which may include an actuator 89. Additional extensible joints 95 may be provided as desired, or as may be required by the specific application. (Note: Only two actuators 89 are visible in the elevation view of FIG. 11.) In certain other embodiments, movable joint 95 may be a rotary joint, e.g., joystick or ball-and-socket joint. In some such embodiments, one rotary actuator may be sufficient to tiltably adjust the top drive 27 relative to the vertical.

In some illustrative embodiments of the present subject matter, one or more sensors 91 may be provided to measure the verticality of the top drive 27. In one embodiment, verticality measurements may be continuously performed, whereas in other illustrative embodiments, verticality measurements may only be performed periodically, or on demand by an operator. For illustrative purposes only, a sensor 91 is shown in FIG. 11 inside the housing of the top drive 27, but may in other embodiments be mounted outside the housing of the top drive 27. The sensor 91 measures the verticality of the top drive 27, which measurements are used to perform adjustments of the movable joint(s) 95. In addition to the sensor 91, the verticality adjustment system may include a processing unit 93 programmed or adapted to determine how to adjust the movable joint(s) 95. For example, if the movable joints 95 are extensible joints, the processing unit 93 may be adapted to determine how far to extend or shorten each of the extensible joints to achieve a desired tilt of the top drive 27. In some embodiments, the processor 93 may receive data from the sensor 91, process the data in order to determine the angular deviation of the top drive 27 from the vertical, and, as necessary, send signals to the movable joints 95 (e.g., the actuators 89) to tiltably adjust the top drive 27 so that the top drive 27 is substantially aligned with the vertical. The processor 93 may in some embodiments be disposed within the housing of the top drive 27, or may in other embodiments be provided in a separate housing with a suitable communication path between the processor 93 and the sensor 91 and movable joints 95.

Figure 12:
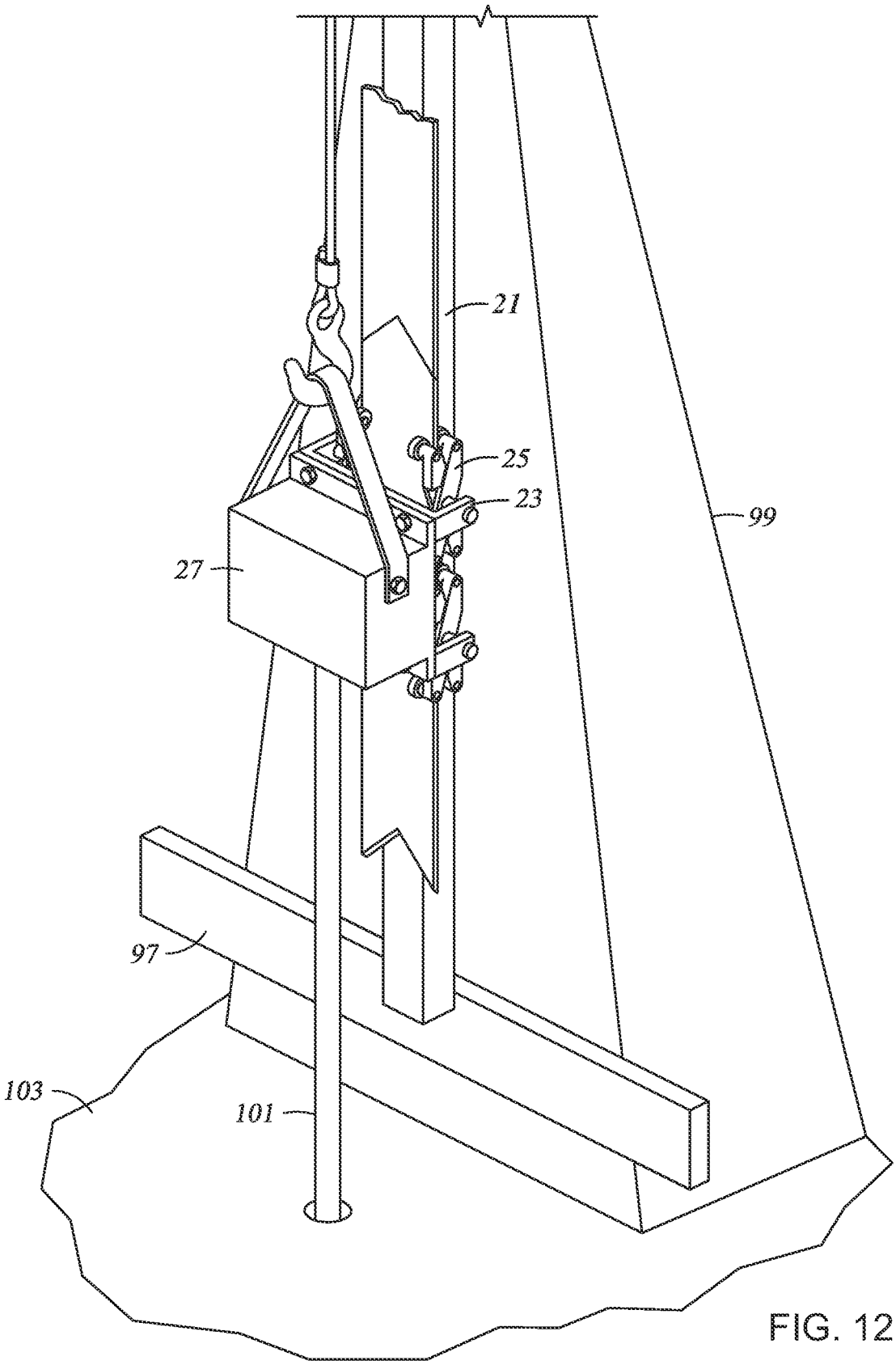
FIG. 12 is a perspective view of one illustrative embodiment of the track guiding system disclosed herein in a drilling environment.

FIG. 12 shows one embodiment of the track 21 in an exemplary environment of use. As shown in FIG. 12, the bottom of the track 21 may be operatively coupled to a plate 97, which may in turn be anchored to a derrick 99. Although not shown, the top of the track 21 may also be secured to the derrick 99. In some embodiments, lateral braces (also not shown) may also be used to secure the track 21 to the derrick at spaced-apart locations along the track 21. The carriage 23 may be supported for travel along the track 21 on the compound edge rollers 25. A top drive 27 may also be coupled to the carriage 23. The length of the track 21 may, in certain embodiments, be selected to match the desired travel length of the top drive 27 along a vertical path provided by the track 21. The top end of a drill string 101 may also be coupled to the top drive 27, while the bottom end of the drill string 101 may extend through the rig floor 103 into a borehole beneath the rig floor 103. With the arrangement illustrated by this embodiment, the top drive 27 may be used to rotate the drill string 101 while also traveling along the track 21 as required by the specific drilling operation.

As described above, the compound edge rollers 25 may be adapted to maintain contact with the track 21 as the top drive 27 travels along the track 21. Furthermore, alignment of the top drive 27 may be maintained in a substantially vertical direction by actively measuring the verticality of the top drive 27 and adjusting the verticality to the top drive 27 as required. In the instant case, the term "verticality" means the angular position of the top drive 27 relative to true vertical. Consequently, if the top drive 27 is precisely aligned with true vertical, then verticality will be zero. Conversely, if the top drive 27 is not precisely aligned with true vertical, then verticality will not be zero. In some illustrative embodiments disclosed herein, the tilt of the top drive 27 relative to the vertical may be adjusted until verticality is substantially zero, or in other words, until the top drive 27 is substantially aligned with the true vertical direction. Moreover, when the top drive 27 is substantially aligned with the true vertical direction, this typically means that the centerline or axis of the top drive 27 is substantially aligned with the true vertical direction.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A track guiding system, comprising:

a track comprising a plurality of track segments, wherein each of said plurality of track segments comprises a linear beam segment and a linear plate segment that is operatively coupled to said linear beam segment, each of said linear plate segments having opposing first and second surfaces separated by a first distance, opposing first and second edges separated by a second distance, and a generally V-shaped prong end separated from a generally V-shaped receptor end by a third distance, wherein said generally V-shaped prong end of a first one of said linear plate segments is adapted to operatively engage said generally V-shaped receptor end of a second one of said linear plate segments;

a first compound edge roller disposed adjacent to and adapted for travel along said first edge of said linear plate and a second compound edge roller disposed adjacent to and adapted for travel along said second edge of said linear plate, wherein each of said first and second compound edge rollers comprises a first roller element disposed adjacent to said first surface of said linear plate and a second roller element disposed adjacent to said second surface of said linear plate; and a carriage coupled to said first and second compound edge rollers.

2. The track guiding system of claim 1, wherein said first distance comprising a plate thickness, said second distance comprising a plate width, and said third distance comprising a plate length.

3. The track guiding system of claim 2, wherein said opposing first and second edges of each of said linear plate segments overhang the respective linear beam segment to which each of said linear plate segments is operatively coupled.

4. The track guiding system of claim 2, wherein an outer edge of said generally V-shaped prong end is tapered along said plate thickness and an inner edge of said generally V-shaped receptor end is tapered along said plate thickness.

5. The track guiding system of claim 4, wherein said tapered outer edge plate thickness of said generally V-shaped prong end and said tapered inner edge plate thickness of said generally V-shaped receptor end are adapted to substantially align said first and second surfaces of said first one of said linear plate segments with said first and second surfaces of said second one of said linear plate segments when said generally V-shaped prong end operatively engages said generally V-shaped receptor end.

6. The track guiding system of claim 2, wherein said generally V-shaped prong end and said generally V-shaped receptor end are adapted to substantially align said first and second edges of said first one of said linear plate segments with said first and second edges of said second one of said linear plate segments when said generally V-shaped prong end operatively engages said generally V-shaped receptor end.

7. The track guiding system of claim 6, further comprising end tabs operatively coupled to each of said linear beam segments, wherein said end tabs are adapted to operatively couple adjacent pairs of linear beam segments and thereby stabilize a connection between adjacent pairs of said plurality of track segments.

8. The track guiding system of claim 7, wherein at least one of said generally V-shaped prong end and said generally V-shaped receptor end of at least one of said linear plate segments overhangs the linear beam segment to which said at least one of said linear plate segments is operatively coupled.

9. The track guiding system of claim 8, wherein said tapered outer edge plate thickness of said generally V-shaped prong end is adapted to engage with said inner edge plate thickness of said generally V-shaped receptor end so as to push said second surface of said second one of said linear plate segments against a linear beam segment that is operative coupled to said first one of said linear plate segments when said generally V-shaped prong end operatively engages said generally V-shaped receptor end.

10. The track guiding system of claim 8, wherein said tapered inner edge plate thickness of said generally V-shaped receptor end is adapted to engage with said outer edge plate thickness of said generally V-shaped prong end so as to push said second surface of said first one of said linear plate segments against a linear beam segment that is operative coupled to said second one of said linear plate segments when said generally V-shaped prong end operatively engages said generally V-shaped receptor end.

11. The track guiding system of claim 2, further comprising alignment plates operatively coupled to each of said linear beam segments in opposing relation to said linear plate segments, wherein each of said alignment plates overhangs an end of said linear beam segment to which said alignment plate is operatively coupled.

12. The track guiding system of claim 1, wherein each of said first and second compound edge rollers further comprises a tensioning member adapted to apply a force to said first and second roller elements such that contact is maintained between said first and second roller elements and said first and second surfaces of said linear plate when said first and second compound edge rollers travel along said first and second edges of said linear plate.

13. The track guiding system of claim 12, wherein each of said first and second compound edge rollers comprises a pair of arms operatively coupled together by a rotatable joint, each arm of said pair of arms bearing one of said first roller element and one of said second roller element.

14. The track guiding system of claim 13, wherein said tensioning member is operatively coupled to said pair of arms and adapted to rotate each arm of said pair of arms about said rotatable joint.

15. The track guiding system of claim 12, wherein each of said first and second compound edge rollers comprises a pair of auxiliary arms operatively coupled to a main arm by rotatable joints, said main arm bearing one each of said first roller element and said second roller element, a first of said pair of auxiliary arms bearing one of said first roller element, and a second of said pair of auxiliary arms bearing one of said second roller element.

16. The track guiding system of claim 15, wherein said tensioning member is operatively coupled to said pair of auxiliary arms and adapted to rotate said pair of auxiliary arms about said rotatable joints.

17. The track guiding system of claim 1, further comprising a top drive operatively coupled to said carriage by at least one movable joint.

18. The track guiding system of claim 17, further comprising a sensor operatively coupled to said top drive, said sensor being adapted for sensing a tilt angle of said top drive relative to a vertical direction.

19. The track guiding system of claim 18, wherein said at least one movable joint comprises at least one actuator.

20. The track guiding system of claim 1, further comprising a third compound edge roller disposed adjacent to said first edge of said linear plate and a fourth compound edge roller disposed adjacent to said second edge of said linear plate, wherein said third and fourth compound edge rollers are operatively coupled to said carriage.

21. A track guiding system, comprising:

a track, said track comprising a linear beam and a linear plate operatively coupled to said linear beam, said linear plate having opposing first and second surfaces separated by a first distance and opposing first and second edges separated by a second distance;

a first compound edge roller disposed adjacent to and adapted for travel along said first edge and a second compound edge roller disposed adjacent to and adapted for travel along said second edge, wherein each of said first and second compound edge rollers comprises a pair of arms operatively coupled together by a rotatable joint, and each arm of said pair of arms comprises a first roller element disposed adjacent to said first surface and a second roller element disposed adjacent to said second surface; and a carriage coupled to said first and second compound edge rollers.

22. The track guiding system of claim 21, wherein each of said first and second compound edge rollers further comprises a tensioning member that is adapted to apply a force to said first and second roller elements such that contact is maintained between said first and second roller elements and said first and second surfaces, respectively, when said first and second compound edge rollers travel along said first and second edges, respectively.

23. The track guiding system of claim 21, wherein said tensioning member is operatively coupled to said pair of arms and adapted to rotate each arm of said pair of arms about said rotatable joint.

* * * * *

UNITED STATES PATENT AND TRADEMARK OFFICE

CERTIFICATE OF CORRECTION

PATENT NO. : 8,424,616 B2
APPLICATION NO. : 12/710634
DATED : April 23, 2013
INVENTOR(S) : Adrian Marica et al.

It is certified that error appears in the above-identified patent and that said Letters Patent is hereby corrected as shown below:

In the Claims:

Col. 14, line 51 (claim 23, line 1), change “claim 21” to -- claim 22 --.

Signed and Sealed this
Eighteenth Day of June, 2013

Teresa Stanek Rea
*Acting Director of the United States Patent and Trademark Office*